US006805723B2

(12) United States Patent
Aune et al.

(10) Patent No.: US 6,805,723 B2
(45) Date of Patent: Oct. 19, 2004

(54) METHOD AND REACTOR FOR PRODUCTION OF ALUMINUM BY CARBOTHERMIC REDUCTION OF ALUMINA

(75) Inventors: Jan Arthur Aune, Ytre Enebakk (NO); Kai Johansen, Kristiansand (NO)

(73) Assignees: Alcoa Inc., Pittsburgh, PA (US); Elkem ASA, Oslo (NO)

( * ) Notice: Subject to any disclaimer, the term of this patent is extended or adjusted under 35 U.S.C. 154(b) by 50 days.

(21) Appl. No.: 10/382,972

(22) Filed: Mar. 6, 2003

(65) Prior Publication Data

US 2004/0173053 A1 Sep. 9, 2004

(51) Int. Cl.[7] ..... C22B 21/02

(52) U.S. Cl. ..... 75/10.27; 75/412; 75/674; 266/160; 266/176; 373/86; 420/580; 420/590

(58) Field of Search ..... 75/10.27, 412, 75/674; 266/160, 176; 373/86; 420/580, 590

(56) References Cited

U.S. PATENT DOCUMENTS

| | | | | |
|---|---|---|---|---|
| 4,099,959 A | | 7/1978 | Dewing et al. | 75/10 R |
| 4,213,599 A | | 7/1980 | Dewing et al. | 266/166 |
| 4,533,386 A | * | 8/1985 | Kibby | 75/10.27 |
| 6,440,193 B1 | | 8/2002 | Johansen et al. | 75/10.27 |

OTHER PUBLICATIONS

Kai Johansen et al. *Carbothermic Aluminum, Sixth International Conference on Molten Slags, Fluxes and Salts*, Jun.12–17, 2000.

* cited by examiner

*Primary Examiner*—Melvyn Andrews
(74) *Attorney, Agent, or Firm*—Glenn E. Klepac; Tracey D. Beiriger

(57) ABSTRACT

A hollow partition wall is employed to feed carbon material to an underflow of a carbothermic reduction furnace used to make aluminum. The partition wall divides a low temperature reaction zone where aluminum oxide is reacted with carbon to form aluminum carbide and a high temperature reaction zone where the aluminum carbide and remaining aluminum oxide are reacted to form aluminum and carbon monoxide.

20 Claims, 3 Drawing Sheets

METHOD AND REACTOR FOR PRODUCTION OF ALUMINUM BY CARBOTHERMIC REDUCTION OF ALUMINA

FIELD OF THE INVENTION

The present invention relates to a process for the production of aluminum by carbothermic reduction of alumina and to a reactor for the production of aluminum by carbothermic reduction of alumina.

BACKGROUND ART

The direct carbothermic reduction of alumina has been described in U.S. Pat. No. 2,974,032 (Grunert et al.) and it has long been recognized that the overall reaction: $Al_2O_3+3C=2Al+3CO$ (1) takes place, or can be made to take place, in two steps: $Al_2O_3+9C=Al_4C_3+6CO$ (2); and $Al_4C_3+Al_2O_3=6Al+3CO$ (3).

Reaction (2) takes place at temperatures below 2000° C. Reaction (3), which is the aluminum producing reaction, takes place at appreciably higher temperatures of 2200° C. and above; the reaction rate increases with increasing temperature. In addition to the species stated in reactions (2) and (3), volatile species including gaseous Al, gaseous aluminum suboxide ($Al_2O$) and CO are formed in reactions (2) and (3) and are carried away with the off gas. Unless recovered, these volatile species will represent a loss in the yield of aluminum. Both reactions (2) and (3) are endothermic.

U.S. Pat. No. 6,440,193 relates to such a process for carbothermic production of aluminum where aluminum carbide is produced together with molten aluminum oxide in a low temperature compartment. The molten bath of aluminum carbide and aluminum oxide flows from the low temperature compartment into a high temperature compartment where the aluminum carbide ($Al_4C_3$) is reacted with the aluminum oxide ($Al_2O_3$) to produce aluminum. In the high temperature compartment, aluminum forms a layer on top of a molten slag layer and is tapped from the high temperature compartment. The off-gases from the low temperature compartment and from the high temperature compartment, which contain Al vapor and volatile aluminum suboxide ($Al_2O$) are reacted to form $Al_4C_3$. The low temperature compartment and the high temperature compartment are located in a common reaction vessel, with the low temperature compartment being separated from the high temperature compartment by an underflow partition wall. The molten bath containing aluminum carbide and aluminum oxide produced in the low temperature compartment continuously flows under the partition wall and into the high temperature compartment by means of gravity flow which is regulated by tapping of aluminum from the high temperature compartment. The energy needed to maintain the temperature in the low temperature compartment and in the high temperature compartment is provided by separate energy supply systems.

In the second step, reaction (3), excess carbon is necessary to promote the production of aluminum. In order to maintain a sufficient carbon content in the high temperature compartment, it is necessary to add additional carbon to the high temperature compartment. According to U.S. Pat. No. 6,440,193 the additional carbon is added through a supply means arranged in the roof of the high temperature compartment thereby requiring the additional carbon to pass through the top layer of molten aluminum in the high temperature compartment and into the molten bath in the high temperature compartment.

SUMMARY OF THE INVENTION

It has been discovered that the addition of carbon material to the top of the molten aluminum can cause a reverse reaction of the aluminum as well as poor distribution of the carbon in the high temperature reaction zone. In order to overcome this problem, it has been discovered that the additional carbon material should be added directly into the slag layer and below the upper aluminum layer, thereby keeping the composition of the slag layer more uniform during the formation of aluminum in the high temperature compartment. It has been further discovered that the additional carbon material should be distributed as evenly as possible in the slag layer in the high temperature compartment. Finally, it has been discovered that the additional carbon material should be added in a controllable manner.

In order to take advantage of these discoveries, a process and a reactor have been invented. Specifically, the process of the present invention comprises adding additional carbon material to the slag as it flows below the partition wall from the low temperature compartment to the high temperature compartment. The reactor of the present invention comprises a means for supplying the additional carbon material to the slag as it flows below the partition wall from the low temperature compartment to the high temperature compartment.

In a preferred embodiment of the present invention, the means for supplying the additional carbon material to the slag layer is an opening in the lower portion of the partition wall. More specifically, the partition wall is hollow with an opening in the bottom that allows additional carbon material to flow out the bottom of the partition wall and into the underflow of slag as it moves from the low temperature compartment to the high temperature compartment of the reactor. A transport means, such as a screw or ram or a combination of a screw and a ram, is employed to move the additional carbon through the wall. Preferably, the hollow partition wall is vertically movable so as to vary the height of the opening in the slag underflow.

By adding the additional carbon material to the underflow of slag at the partition wall, the additional carbon material is added directly into the slag, below the level of the upper aluminum layer, and the amount of added carbon material can be evenly distributed throughout the slag in the high temperature compartment. Since the partition wall is vertically movable, the point of addition for the additional carbon material can be varied. Normally the vertical position of the wall is only adjusted when the furnace is not in operation. Furthermore, the amount of carbon added to the slag can be controlled by the speed at which the transport means moves the additional carbon material through the wall.

Preferably, the hollow area and the opening in the partition wall extend across the entire wall. Alternatively, the hollow area can be divided into a series of channels or into vertically oriented conduits. Each conduit has an opening at the base of the wall to conduct additional carbon material downward and feed the additional carbon material into the underflow of slag.

Broadly, the present invention is a process for supplying additional carbon material to a reactor for carbothermic production of aluminum wherein the reactor is divided into a low temperature compartment and a high temperature compartment by a hollow underflow partition wall. A molten bath or slag comprising aluminum carbide and aluminum oxide is produced in the low temperature compartment. The molten bath of aluminum carbide and aluminum oxide flows under the hollow underflow partition wall into the high temperature compartment where the aluminum carbide is reacted with alumina to produce aluminum which forms a layer on top of the molten slag bottom layer and where aluminum is tapped from the high temperature compartment. The additional carbon material is supplied to the molten bath of aluminum carbide and aluminum oxide through at least one opening in the hollow underflow partition wall, said opening being at a level below the layer of molten aluminum in the high temperature compartment. In other words, the opening is positioned in the wall at the level of the slag as it flows under the wall.

The reactor of the present invention is a reactor for carbothermic production of aluminum which comprises a reaction vessel comprising a low temperature reaction compartment and a high temperature reaction compartment. The low temperature compartment has means for supply of materials to said compartment and one or more electrodes for supplying electric operating current to said compartment, said electrode or electrodes being positioned for submersion in a molten bath which is produced in the low temperature compartment. The high temperature reaction compartment is separated from the low temperature compartment by means of a hollow partition wall. The hollow partition wall has at least one opening into the underflow of the molten bath which allows underflow of the molten bath from the low temperature reaction compartment to the high temperature compartment. A plurality of pairs of substantially horizontally arranged electrodes are arranged in the sidewall of the high temperature compartment of the reaction vessel for supply of electric current to said compartment. The high temperature compartment has an outlet for continuously tapping molten aluminum. The molten bath produced in the low temperature compartment flows into the high temperature compartment by gravity flow effected by tapping the top aluminum layer in the high temperature compartment. The at least one opening in the partition wall is positioned at a level below the layer of molten aluminum in the high temperature compartment.

In accordance with the present invention, the additional carbon material can take the form of coke, coal, agglomerated carbon powder or any other form. Also, additional carbon material can take the form of $Al_4C_3$, which is preferred in order to reduce the amount of CO gas produced in the high temperature compartment as well as to recycle $Al_4C_3$ from off-gas reactors connected to the high and low temperature compartments. Finally, $Al_4C_3$ filtered off from the produced aluminum tapped from the reactor can also be used as a form of additional carbon material.

BRIEF DESCRIPTION OF THE DRAWINGS

These and other aspects of the present invention may be more fully understood with reference to the drawings wherein.

DETAILED DESCRIPTION OF INVENTION

Figure 1:
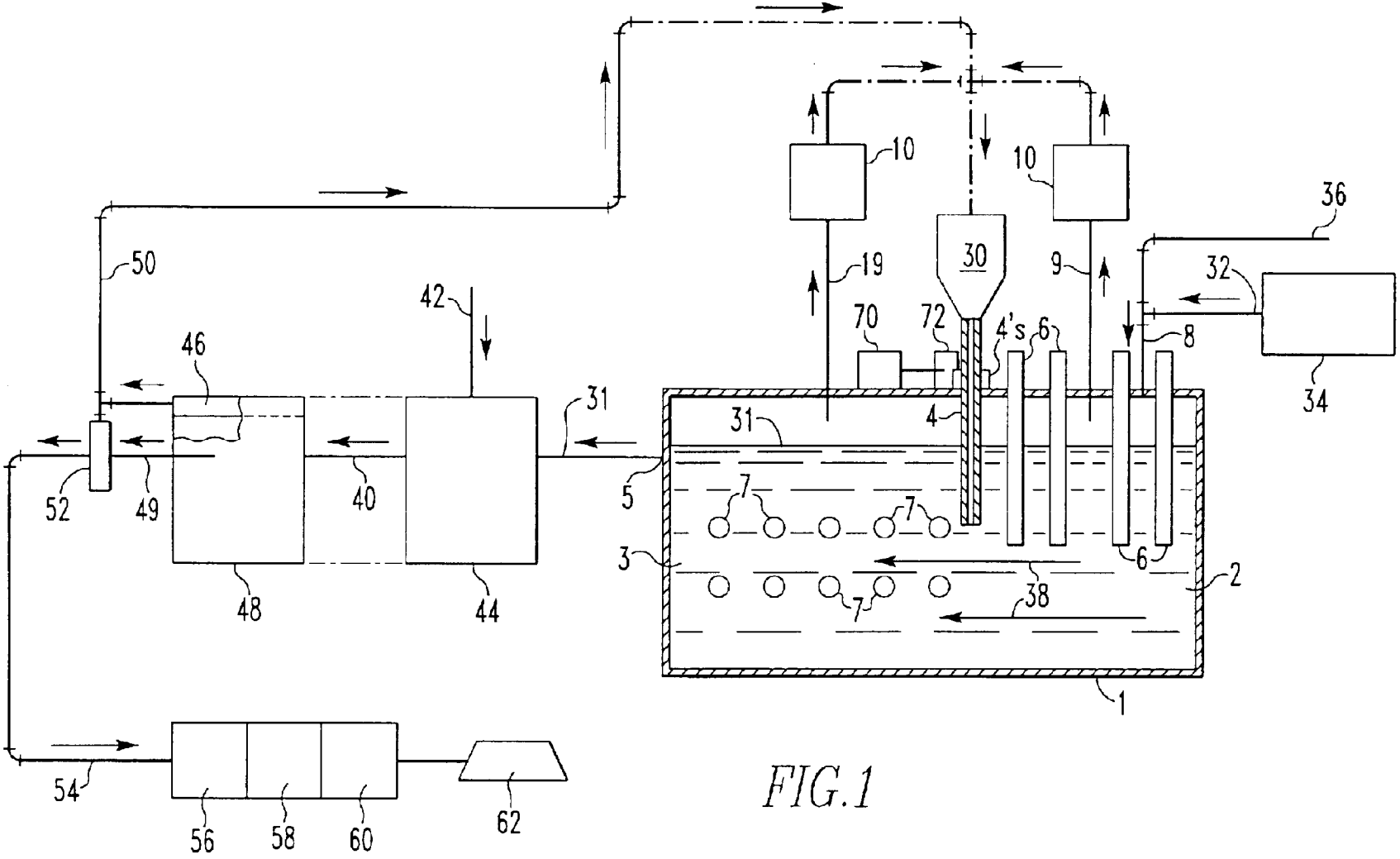
FIG. 1 is a cross-sectional view of a preferred embodiment of a reactor vessel according to the present invention.

FIG. 1 shows a generally rectangular-shaped gas tight reaction vessel 1 divided into a low temperature compartment 2 and a high temperature compartment 3 by means of a hollow underflow partition wall 4 that allows flow of a molten bath from the low temperature compartment 2 to the high temperature compartment 3 and the addition of additional carbon material to the flow of molten bath as it passes under partition wall 4. At the end of the high temperature compartment 3 opposite the low temperature compartment 2 there is arranged an outlet 5 for tapping or removing a layer of molten aluminum 31. The molten bath flows from the low temperature compartment 2 to the high temperature compartment 3 by gravity. The flow is effected and regulated by the tapping of aluminum 31 at outlet 5. When aluminum is tapped from the high temperature compartment, a corresponding amount of molten bath flows under the partition wall from the low temperature compartment to the high temperature compartment. The two compartments are not connected by separate ducting.

In the low temperature compartment 2 there are arranged a plurality of electrodes 6, usually two to four, extending through the roof of the reaction vessel 1. The electrodes 6 are, during the operation of the reaction vessel 1, intended to pass through the bath and to be submerged in the molten bath in the low temperature compartment 2 to supply energy by resistance heating. The electrodes 6 may have conventional means (not shown) for supply of electric current and conventional means (not shown) for regulating the electrodes 6. The electrodes 6 are preferably consumable graphite electrodes, although any other material suitable for such use can also be employed.

In the high temperature compartment 3 there are arranged a plurality of pairs of electrodes 7 along the sidewalls of the reaction vessel 1. In FIG. 1 the side view electrodes are depicted as circles as they protrude from one wall and so only one electrode of each set is shown. The electrodes 7 can be consumable graphite electrodes or non-consumable inert electrodes. Each pair of electrodes 7 is individually supplied with electric current. By using a plurality of pairs of electrodes 7 in the sidewall of the reaction vessel 1, an even temperature is reached in the molten bath in the high temperature compartment 3. As shown, the electrodes 7 do not pass through the top of the bath and are disposed below the level of the aluminum layer 31, providing advantages described previously. In the roof of the low temperature compartment 2 there is arranged supply means 8 for supply of alumina 32 from hopper 34 and carbonaceous reduction material 36 to the low temperature compartment 2. The supply means 8 is preferably gas tight so that raw materials can be supplied without the escape of reactor off-gases through the supply means 8.

Over the roof in the low temperature compartment 2 there is further arranged a first gas exit 9. The gas exit 9 can pass to reactor 10 to recover $Al_4C_3$.

Over the roof in the high temperature compartment 3 there is arranged a second gas exit 19 which is identical to the gas exit 9 arranged on the roof over the low temperature compartment 2. Off-gases from the high temperature compartment 3 can pass to another rector 10 to recover $Al_4C_3$. Gases flowing through exits 9 and 19 could also both pass through the same reactor 10.

Hollow partition wall 4 has hopper 30 positioned on top to hold additional carbon material and to feed additional carbon material down through hollow partition wall 4 into the underflow molten bath. Recovered $Al_4C_3$ from reactor 10 is preferably recycled to hopper 30 for use as additional carbon material. Hopper 30 and hollow partition wall 4 are preferably gas tight so that additional raw material can be supplied to the reactor without the escape of reactor off-gases.

Figure 2:
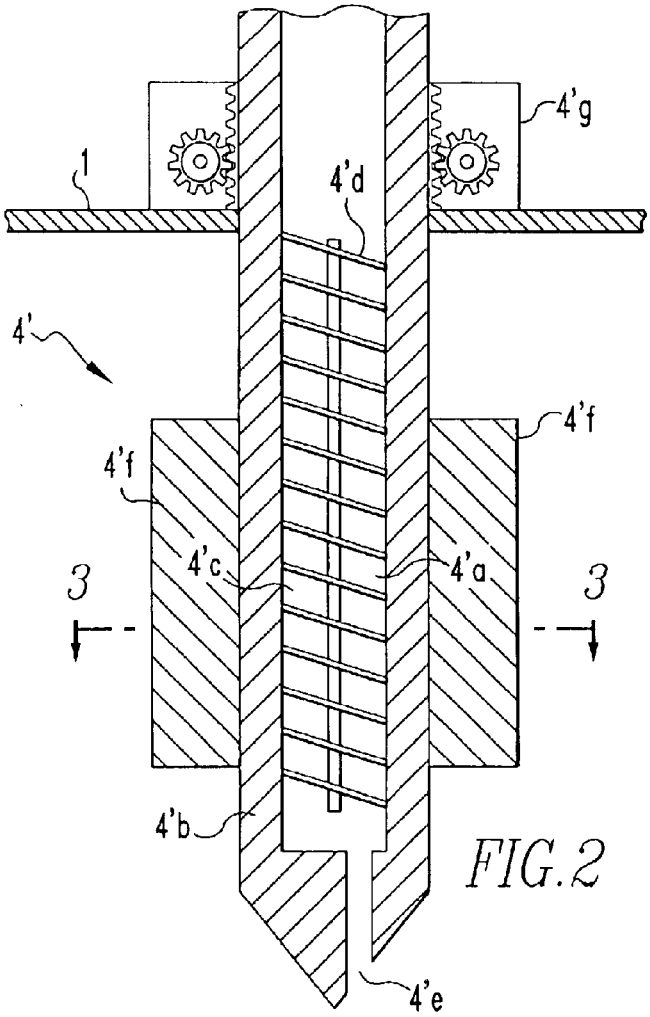
FIG. 2 is a cross-sectional view of a hollow partition wall.
Figure 3:
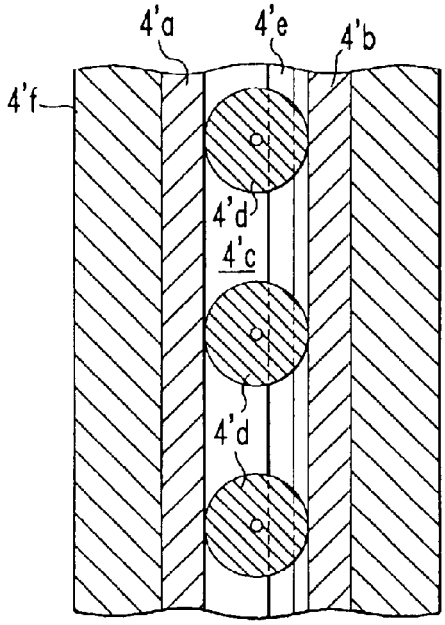
FIG. 3 is a top view of the hollow partition wall of FIG. 2 taken along line 3—3.

FIG. 2 illustrates a cross-sectional view of a preferred embodiment of hollow partition wall 4' while FIG. 3 shows a top view of the wall taken along line III—III of FIG. 2. Wall 4' comprises sides 4'*a* and 4'*b* and space 4'*c* for holding carbon material and housing a screw 4'*d* to transport additional carbon material down through space 4'*c* and out opening 4'*e* at the bottom of wall 4'. Preferably, cooling system 4'*f* is provided on the outside of wall 4'. Cooling system 4'f is a conventional cooling system operated in conventional manner. A rack and pinion system 4'g is used to vertically move wall 4'. By moving wall 4', the level of opening 4'*e* varies thereby allowing for control of the height of addition of the additional carbon material into the underflow slag. The speed at which screw 4'*d* is operated controls the amount of additional carbon material fed through opening 4'*e*.

Rack and pinion system 4'*g* is a conventional system operated in a conventional manner to move wall 4' and adjust the height at which additional carbon material is fed to the slag.

Cooling system 4'*f* also aids in guiding the movement of wall 4'.

Figure 5:
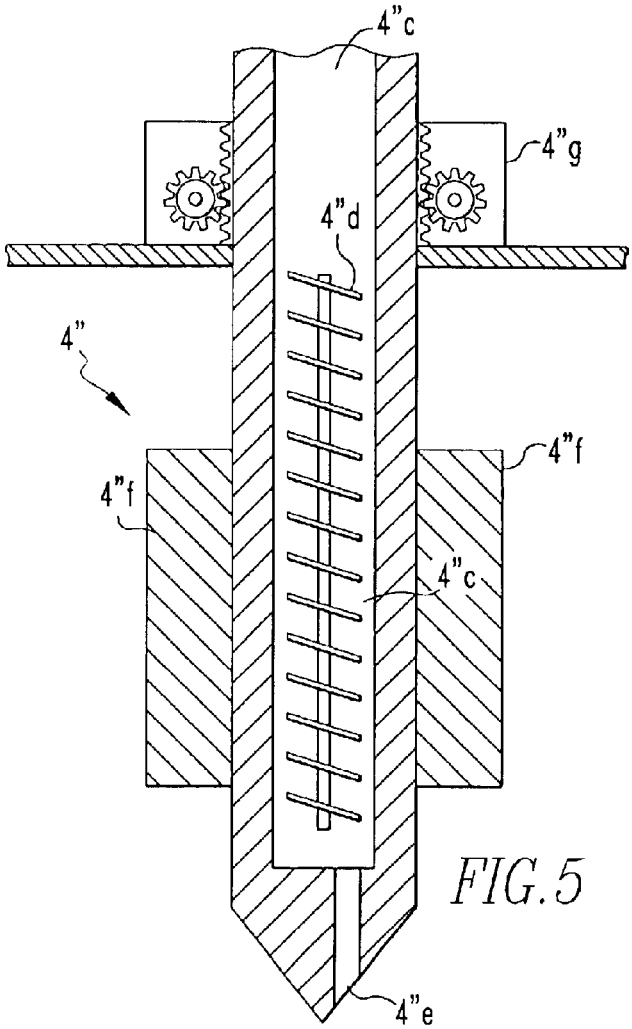
FIG. 5 is a side view of the partition wall of FIG. 4 taken along line 5—5.
Figure 4:
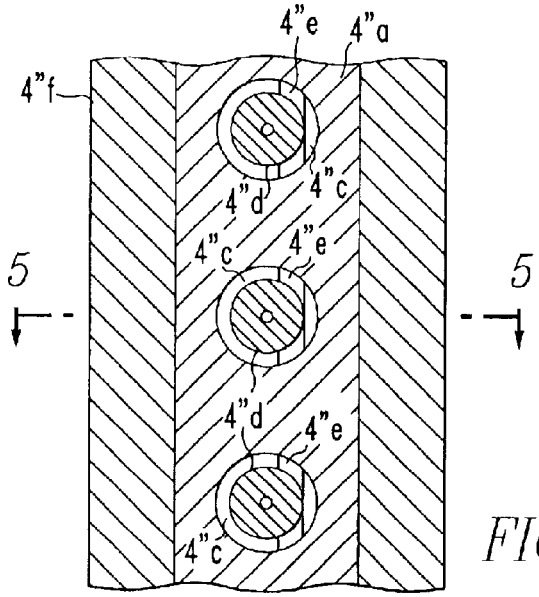
FIG. 4 is a top view of a partition wall with a plurality of conduits therein.

FIGS. 4 and 5 illustrate another embodiment wherein the hollow area has been divided into a plurality of conduits. Such conduits can also be seen as circular spaces or hollows. Partition wall 4" has spaces 4"*c* and screws 4"*d* positioned therein to feed carbon material downward through space 4"*c* to the underflow slag. The amount of additional carbon material added to the underflow slag is controlled by the speed at which screws 4"*d* are turned in spaces 4"*c*. The faster the speed, the more additional carbon material is added to the underflow slag. Additional carbon material passes out of wall 4" through openings 4"*e*. Cooling/protective layer 4"*f* is also provided on wall 4".

Screws 4'*c* and 4"*c* are conventional devices operated in a conventional manner to move the solid particulate additional carbon material down through spaces 4'*c*, 4"*c* and out openings 4'*e*, 4"*e*, respectively. Preferably, the motors used to turn screws 4'*c*, 4"*c* are variable to provide for a change of speed and control of the amount of additional carbon material added to the underflow slag.

A preferred embodiment providing an example for carrying out the process according to the present invention will now be described in connection with FIG. 1. A charge of alumina and carbon is supplied through the supply means 8 to the low temperature compartment 2. Electric energy is supplied through the electrodes 6 to provide and maintain a molten slag bath of alumina and $Al_4C_3$ at a temperature of about 2000° C. The electrodes 6 are submerged in the molten slag bath whereby the energy is transferred to the molten slag bath by resistance heating. The off gas from the low temperature compartment 2, which usually will contain $CO_1Al_2O$ and some Al vapor, is withdrawn through an off gas duct and into the lower part of the off gas exit 9. The $Al_4C_3$ which is recovered in reactor 10 is preferably recycled to the reactor through hopper 30 and hollow partition wall 4.

The molten slag consisting of aluminum carbide and alumina produced in the low temperature compartment 2 will continuously flow under hollow partition wall 4 and into the high temperature compartment 3. Additional carbon material from hopper 30 will flow down through hollow partition wall 4 and into the molten slag flowing under wall 4.

As shown in FIGS. 2–5, screws 4'*d*, 4"*d* are rotated to transport additional carbon material through walls 4', 4" and out openings 4'*e*, 4"*e*, respectively. Rack and pinion system 4'*g* is employed to raise and lower wall 4' thereby varying the height of opening 4'*e* in the slag. The speed of screws 4'*d*, 4"*d* is varied to control the amount of additional carbon material that flows down from hopper 30 and into the underflow slag.

In the high temperature compartment 3 the temperature of the molten slag is increased to 2100° C. or more by supply of electric current to the plurality of sidewall electrodes 7, which heat the slag bath by resistance heating. By using a plurality of pairs of electrodes 7 arranged along the sidewalls of the high temperature compartment 3, below rather than through molten aluminum layer 31, very importantly, the temperature can be controlled in slag bath along the length of the high temperature compartment 3, and localized superheating is reduced or avoided. This process involves essentially horizontal flow of the molten slag into high temperature compartment 3, as shown by the arrows 38 in compartment 2, without need of a separate heating duct or use of gases to effect slag flow.

By maintaining the temperature in the slag bath in the high temperature compartment 3 at a temperature above about 2100C., aluminum carbide will react with alumina to produce Al and CO gas. The additional carbon will replace carbon consumed during the Al producing reaction. Due to the high temperature, an appreciable amount of produced Al will vaporize together with $Al_2O$ and will leave the furnace with the off gas. The liquid Al produced in the high temperature compartment 3 will, due to its low density, form a molten layer 31 on top of the molten slag bottom layer and it is tapped from the furnace through the overflow outlet 5. There is no need to recirculate the remaining slag back into the low temperature compartment 2 by separate ducting, saving substantial costs and simplifying the process. During the reaction of aluminum carbide and alumina, the molten slag bath in the high temperature compartment will be depleted of carbon. Additional carbon material is therefore supplied to the high temperature compartment 3 through hollow partition wall 4. In addition to carbon material, solid alumina can be charged to the high temperature compartment 3 through hollow partition wall 4.

The aluminum produced in the high temperature compartment 3 will be saturated with molten aluminum carbide. The superheated aluminum in the high temperature compartment 3 is continuously tapped through the over/underflow outlet 5 and can be passed to downstream operations. The aluminum is then cooled to form a stream 40, preferably by addition of aluminum scrap 42 in cooling vessel 44, to a temperature above the melting point for aluminum. When the aluminum is cooled, a major part of the aluminum carbide dissolved in the aluminum will precipitate as solid aluminum carbide 46 and can be skimmed off from the cooled molten aluminum in purification vessel 48. Vessels 44 and 48 can be combined. The remaining aluminum carbide 50 can be removed by conventional means, such as by passing stream 49 through filter 52. The aluminum carbide removed from the aluminum after tapping is preferably recycled to the low temperature compartment 2 and/or to hollow partition wall 4. The cooling vessel, purification vessel and filter may be of any type useful to perform its function.

The purified aluminum stream 54 may then be passed to any number of apparatuses, such as degassing apparatus 56 to remove, for example, $H_2$, fluxing apparatus 58 to scavenge oxides from the melt and eventually to casting apparatus 60 to provide unalloyed primary shapes such as ingots 62 or the like of about 50 lb. (22.7 kg) to about 750 lb. (341 kg). These ingots may then be remelted for final alloying in a holding or blending furnace or the melt from fluxing apparatus may be directly passed to a furnace for final alloying and casting as alloyed aluminum shapes. Elements such as Cu, Fe, Si, Mg, Ni, Cr, etc. may be added to the blending furnace as rich alloy ingots such as 82% Al/18% Cu since addition in pure form may not be feasible. These operations are well known and described, for example, in *Aluminum*, Vol. III, Ed. Kent R. Van Horn, Amer. Soc. of Metals (1967), pp. 18–36, herein incorporated by reference.

The amount and location of carbon in the slag layer of the high temperature compartment 3 can be measured by sensor 70 or by measuring the electric resistance of the slag. This helps to determine both the amount of carbon present and whether the carbon is evenly distributed in the slag layer. Sensor 70 is a conventional sensor operated in a conventional manner.

Sensor 70 communicates with screw motor 72 and rack and pinion system 4'*g* to control the amount of carbon material added as well as the height in the slag layer where the carbon material is to be added. Individual motors of each screw conveyor 4'*d*, 4"*d* are independently controlled to control the addition of carbon material in a third dimension. In particular, if additional carbon material is needed along the sides of the furnace, only screws 4'*d*, 4"*d* at the ends of walls 4', 4" are operated while the screws 4'*d*, 4"*d* in the middle of wall 4', 4" are stopped. As will be appreciated, independent control of each of screws 4'*d*, 4"*d* along with rack and pinion system 4'*g* allows for three-dimensional control of the addition of carbon material through walls 4', 4".

It will be understood that the claims are intended to cover all changes and modifications of the preferred embodiments of the invention herein chosen for the purpose of illustration which do not constitute a departure from the spirit and scope of the invention.

Having described the presently preferred embodiments, it is to be understood that the invention may be otherwise embodied within the scope of the appended claims.

What is claimed is:

1. A process for carbothermic production of aluminum where a molten bath comprising aluminum carbide is produced in a low temperature compartment, which molten bath flows into a high temperature compartment where the aluminum carbide is reacted with alumina to produce aluminum which forms a layer above a molten slag; wherein the low temperature compartment and the high temperature compartment are located in a common reaction vessel and the low temperature compartment is separated from the high temperature compartment by a hollow underflow partition wall having an opening in the wall; the molten bath produced in the low temperature compartment continuously flows under the partition wall and into the high temperature compartment, and where additional carbon material is supplied to the flow under the partition wall through the opening in the hollow partition wall.

2. The process according to claim 1, wherein the hollow partition wall is vertically movable.

3. The process according to claim 1, wherein the amount of additional carbon material added to the slag is varied by controlling the speed of movement of a transport means supplying carbon material to the flow under the partition wall.

4. The process according to claim 1, wherein the off-gases from the low temperature compartment and from the high temperature compartment are reacted to form $Al_4C_3$ and the $Al_4C_3$ is fed to the flow under the wall.

5. The process according to claim 3, wherein the carbon content of the slag in the high temperature compartment is measured and fed back to the transport means.

6. The process according to claim 1, further comprising sensing the amount of carbon in the slag of the high temperature compartment and varying the amount of carbon material added through the particles wall accordingly.

7. The process according to claim 1, wherein the tapped aluminum contains aluminum carbide, and wherein the aluminum carbide is precipitated and the purified aluminum is alloyed and then cast into alloyed aluminum shapes, said aluminum carbide being fed as additional carbon material to the flow under the wall.

8. The process according claim 1, wherein the tapped aluminum contains aluminum carbide, and wherein said tapped aluminum is cooled to precipitate the aluminum carbide, followed by filtering, degassing, and then casting in an ingot casting machine to form aluminum shapes, said precipitated aluminum carbide being fed as additional carbon material to the flow under the wall.

9. A reactor for carbothermic production of aluminum, comprising a reaction vessel comprising a low temperature reaction compartment having means for supply of materials to said compartment and one or more electrodes for supplying electric operating current to said compartment, said electrode or electrodes being positioned for submersion in a molten bath in the low temperature compartment;

a high temperature compartment separated from the low temperature compartment by means of a hollow partition wall allowing underflow of molten bath from the low temperature reaction compartment into the high temperature compartment, said wall having an opening and a transport means feeding additional carbon material to the underflow through the opening in the hollow partition wall;

electrodes arranged in a sidewall of the high temperature compartment of the reaction vessel for supply of electric current to said compartment;

means for injecting material into the high temperature compartment; and an outlet for continuously tapping molten aluminum from the high temperature compartment.

10. The reactor according to claim 9, wherein the reaction vessel has a substantially rectangular shape, and wherein the partition wall is vertically movable.

11. The reactor according to claim 9, wherein the transport means is variable to control the rate of feed of the additional carbon material to the underflow.

12. The reactor according to claim 9, further comprising a sensor to detect the carbon content in the high temperature compartment.

13. The reactor according to claim 9, wherein the one or more off-gas reactors are connected to the reactor compartments for producing $Al_4C_3$ and a hopper is used to supply carbon material to the hollow partition wall.

14. The reactor according to claim 13, further comprising means for supplying to the hopper the $Al_4C_3$ produced in said off-gas reactors.

15. The reactor according to claim 9, wherein the transport means comprises at least one screw.

16. The reactor according to claim 9, wherein the hollow partition wall defines a plurality of spaces each with a separate transport means.

17. In a reactor for producing aluminum by carbothermic reduction of alumina having a single reactor with two compartments, a high temperature reaction compartment and a low temperature reaction compartment, and an underflow partition wall that separates the two compartments where slag flows under the partition wall from the low temperature compartment to the high temperature compartment, the improvement comprising:

a supply means for supplying additional carbon material through the underflow partition wall to the slag flowing from the low temperature compartment to the high temperature compartment.

18. The reactor of claim 17, wherein said supply means includes a hollow area in said partition wall and one or more openings in said wall, said one or more openings being in the lower portion of said wall to connect said hollow area with said flow.

19. The reactor of claim 17, wherein said supply means includes one or more conduits positioned in said partition wall, each conduit having an opening in the lower portion of said partition wall which connects said conduit with said flow.

20. The reactor of claim 17, wherein a hopper is in communication with said supply means to provide said supply means with said additional carbon material.

* * * * *

UNITED STATES PATENT AND TRADEMARK OFFICE

CERTIFICATE OF CORRECTION

PATENT NO. : 6,805,723 B2
DATED : October 19, 2004
INVENTOR(S) : Aune et al.

It is certified that error appears in the above-identified patent and that said Letters Patent is hereby corrected as shown below:

Column 1,
Line 5, insert the following paragraph:

-- Statement Regarding Federally Funded Research

The subject matter of this application was made with United States Government support under Contract No. DE-FC36-OOID13900 awarded by The Department of Energy. The United States Government has certain rights to this invention. --.

Signed and Sealed this

Eighth Day of November, 2005

JON W. DUDAS
*Director of the United States Patent and Trademark Office*